US007776409B2

(12) United States Patent
Goto et al.

(10) Patent No.: US 7,776,409 B2
(45) Date of Patent: Aug. 17, 2010

(54) ELECTRODE FOR DISCHARGE SURFACE TREATMENT AND METHOD OF EVALUATING THE SAME, AND DISCHARGE-SURFACE-TREATING METHOD

(75) Inventors: Akihiro Goto, Tokyo (JP); Masao Akiyoshi, Tokyo (JP); Katsuhiro Matsuo, Aichi (JP); Hiroyuki Ochiai, Tokyo (JP); Mitsutoshi Watanabe, Tokyo (JP); Takashi Furukawa, Tokyo (JP)

(73) Assignees: Mitsubishi Denki Kabushiki Kaisha, Tokyo (JP); Ishikawajima-Harima Heavy Industries Co. (JP)

( * ) Notice: Subject to any disclaimer, the term of this patent is extended or adjusted under 35 U.S.C. 154(b) by 1035 days.

(21) Appl. No.: 11/297,462

(22) Filed: Dec. 9, 2005

(65) Prior Publication Data

US 2006/0086695 A1 Apr. 27, 2006

Related U.S. Application Data

(63) Continuation-in-part of application No. PCT/JP2004/000734, filed on Jan. 28, 2004.

(30) Foreign Application Priority Data

Jun. 10, 2003 (JP) ..... 2003-164483

(51) Int. Cl.
*B05D 3/06* (2006.01)

(52) U.S. Cl. ..... 427/580; 219/69.17; 219/76.13

(58) Field of Classification Search ..... 219/69.17, 219/76.13; 427/580
See application file for complete search history.

(56) References Cited

U.S. PATENT DOCUMENTS

| | | | | |
|---|---|---|---|---|
| 4,866,237 | A * | 9/1989 | Inoue | 219/76.13 |
| 5,858,479 | A * | 1/1999 | Saito et al. | 427/580 |
| 6,086,684 | A | 7/2000 | Saito et al. | |
| 6,336,950 | B1 | 1/2002 | Koizumi et al. | |
| 2002/0000369 | A1 * | 1/2002 | Mohri et al. | 204/192.12 |

FOREIGN PATENT DOCUMENTS

CH 693 872 A5 3/2004

(Continued)

OTHER PUBLICATIONS

Formation of hard layer on metallic Material by EDM Akihiro Goto et al. Proc. International Symposium for Electro-machining (ISEM 12) (1998).

(Continued)

*Primary Examiner*—Geoffrey S Evans
(74) *Attorney, Agent, or Firm*—Sughrue Mion, PLLC

(57) ABSTRACT

A method of evaluating an electrode for discharge surface treatment for generating a discharge between the electrode and a workpiece in a treatment liquid or in the air using a green compact obtained by molding a metal, metal compound, or ceramic powder or other green compact obtained by heating the green compact as the electrode, and forming a coat consisting of an electrode material or a substance obtained by a reaction of the electrode material by a discharge energy on a surface of the workpiece, includes evaluating a capability of the electrode to deposit the coat based on an amount of deposition of the electrode material on the surface of the workpiece by a single discharge.

11 Claims, 14 Drawing Sheets

FOREIGN PATENT DOCUMENTS

| | | | |
|---|---|---|---|
| CN | 1272144 | A | 11/2000 |
| CN | 1322162 | A | 11/2001 |
| EP | 1 630 255 | A | 3/2006 |
| EP | 1 643 007 | A | 4/2006 |
| JP | 5-148615 | A | 6/1993 |
| JP | 7-197275 | A | 8/1995 |
| JP | 8-300227 | A | 11/1996 |
| JP | 11-229159 | A | 8/1998 |
| JP | 10-337617 | A | 12/1998 |
| JP | 11-106948 | A | 4/1999 |
| JP | 2000-096105 | A | 4/2000 |
| JP | 2001-138141 | A | 5/2001 |
| JP | 3227454 | B2 * | 11/2001 |
| WO | WO 99/58744 | A1 | 11/1999 |
| WO | WO 01/05545 | A1 | 1/2001 |
| WO | WO 01/23640 | A | 4/2001 |
| WO | WO 01/23641 | A1 | 4/2001 |
| WO | WO 01/24961 | A1 | 4/2001 |

OTHER PUBLICATIONS

Development of Electrical Discharge Coating Method Akihiro Goto et al. Proc. International Symposium for Electro-machining (ISEM 13) (2001).

Supplementary European Search Report dated Jun. 25, 2009.

* cited by examiner

ELECTRODE FOR DISCHARGE SURFACE TREATMENT AND METHOD OF EVALUATING THE SAME, AND DISCHARGE-SURFACE-TREATING METHOD

This is a Continuation-in-Part of PCT/JP2004/000734 filed on Jan. 28, 2004 and which claims priority from Japanese Patent Application No. 2003-164483 filed on Jun. 10, 2003, the above-noted applications incorporated herein by reference in their entirety.

BACKGROUND OF THE INVENTION

1) Field of the Invention

The present invention relates to an electrode for discharge surface treatment for generating a pulsed electric discharge between the discharge surface-treating electrode and a workpiece in a treatment liquid or in the air using, as the discharge surface-treating electrode, a green compact obtained by compression-molding metal, metal compound, or ceramic powder or a green compact obtained by heating the green compact, and for forming a coat, which consists of an electrode material or a substance obtained by provoking a reaction of the electrode material by a discharge energy, on a surface of the workpiece using a discharge energy of the pulsed electric discharge, and a method of evaluating the electrode for discharge surface treatment. The present invention also relates to a discharge-surface-treating method using the electrode for discharge surface treatment.

2) Description of the Related Art

Recently, there is an increasing demand for a coat that has an abrasion resistance and a lubricity in a high temperature environment such as for use for a turbine blade of an aircraft gas turbine engine. FIG. 1 is a schematic diagram of a structure of the turbine blade of the aircraft gas turbine engine. As shown in the drawing, a plurality of turbine blades 1000 are brought into contact with and fixed to one another, and are constituted to be turned around a shaft (not shown). Contact portions P of the turbine blades 1000 are badly worn and stricken when the turbine blades 1000 are turned in a high temperature environment.

In such a high temperature environment (700° C. or higher) in which the turbine blades 1000 are used, a coat having an abrasion resistance and a lubricity in an ordinary temperature environment is oxidized in the high temperature environment. Therefore, the coat is hardly effective. Due to this, a coat (thick film) consisting of an alloy material that contains a metal (e.g., Cr (chromium) or Mo (molybdenum)) for generating an oxide exhibiting the lubricity in the high temperature environment is formed on each turbine blade 1000 or the like. The coat of this type is formed by a welding method, a thermal spraying method, or the like.

An operation based on each of the welding method, the thermal spraying method, and the like is manually performed and requires skill. It is, therefore, disadvantageously difficult to execute the operation as a line operation, and an operation cost is disadvantageously increased. Further, the welding method, in particular, involves a step of intensively applying heat into the workpiece (hereinafter, "work"). For this reason, the welding method has disadvantages in that a welding crack and a deformation tend to occur and yield is low if a treatment target is a thin material or a brittle material such as a single-crystal alloy or a directionally controlled alloy such as a directionally solidified alloy.

A method for forming a coat on a surface of a work using a pulsed electric discharge (hereinafter, "discharge surface treatment") is disclosed in International Publication No. 99/58744 pamphlet and the like. In this discharge surface treatment, the coat is formed by generating an ark discharge between an electrode, which consists of a green compact obtained by compression-molding powder to be generally as hard as a chalk, and a work, and by resolidifying an electrode material molten by this arc discharge on the surface of the work. This discharge surface treatment is drawing attention as a technique for enabling a line operation in place of the welding method, the thermal spraying method, or the like. In the conventional discharge surface treatment, a coat consisting of a hard material such as TiC (titanium carbide), exhibiting an abrasion resistance at the ordinary temperature is formed.

Recently, a demand for forming not only the hard ceramic coat having the abrasion resistance at the ordinary temperature but also a thick film of 100 micrometers or more using the discharge surface treatment that can be executed as a line operation without the need of a manual and skilful operation is growing.

The method disclosed in the International Publication No. 99/58744 pamphlet is, however, mainly targeted to form the thin film that exhibits the abrasion resistance at the ordinary temperature. With this method, therefore, the coat that exhibits an abrasion resistance or a lubricity in the high temperature environment cannot be formed. Besides, in the formation of the thick film by the discharge surface treatment, it is known that supply of a material from an electrode side, welding of the supplied material on the work surface, and how the supplied material is bound with the work material are the most influential factors for the coat performances. However, the International Publication No. 99/58744 fails to clarify a supply amount of the electrode material necessary to form the thick film, electrode conditions, and working conditions.

The supply amount of the electrode during the discharge surface treatment is disclosed in a conventional technique, although the technique is a thin film forming technique (see, for example, Akihiro Goto et al., Development of Electrical Discharge Coating Method, Proc. International Symposium for Electro-machining (ISEM 13), 2001). According to the thin film forming technique, the thin film is formed by the discharge surface treatment by moving an electrode material onto a work by a single discharge and by increasing parts covered with the electrode material or a material modified from the electrode material on the work by a plurality of discharges.

SUMMARY OF THE INVENTION

It is an object of the present invention to solve at least the above problems in the conventional technology.

A method according to one aspect of the present invention, which is for evaluating an electrode for discharge surface treatment for generating a discharge between the electrode and a workpiece in a treatment liquid or in the air using a green compact obtained by molding a metal, metal compound, or ceramic powder or other green compact obtained by heating the green compact as the electrode, and forming a coat consisting of an electrode material or a substance obtained by a reaction of the electrode material by a discharge energy on a surface of the workpiece, includes evaluating a capability of the electrode to deposit the coat based on an amount of deposition of the electrode material on the surface of the workpiece by a single discharge.

A method according to another aspect of the present invention, which is for evaluating an electrode for a discharge surface treatment, includes manufacturing an electrode for evaluation by molding a metal, metal compound, or ceramic powder; performing a single discharge on a workpiece using the electrode manufactured; observing a trace of the single discharge formed on a surface of the workpiece; and determining a coating capability of the electrode for discharge surface treatment, which is manufactured under a same manufacturing condition as that for the electrode for evaluation, based on a result of the observing.

An electrode according to still another aspect of the present invention, which is for discharge surface treatment for generating a discharge between the electrode and a workpiece in a treatment liquid or in the air using a green compact obtained by molding a metal, metal compound, or ceramic powder or other green compact obtained by heating the green compact as the electrode, and forming a coat consisting of an electrode material or a substance obtained by a reaction of the electrode material by a discharge energy on a surface of the Workpiece, has the electrode material deposited on the surface of the workpiece in a shape of an elliptical arc by a single discharge.

An electrode according to still another aspect of the present invention, which is for discharge surface treatment for generating a discharge between the electrode and a workpiece using a green compact obtained by molding a cobalt powder having an average particle diameter of 3 micrometers or less as the electrode, and forming a coat on a surface of the workpiece by a discharge energy, has the cobalt powder molded heated at a predetermined temperature.

An electrode according to still another aspect of the present invention, which is for discharge surface treatment for generating a discharge between the electrode and a workpiece using a green compact obtained by molding an alloy powder having an average particle diameter of 3 micrometers or less as the electrode, and forming a coat on a surface of the workpiece by a discharge energy, has the alloy powder molded heated at a predetermined temperature.

A discharge-surface-treating method according to still another aspect of the present invention, which is for forming a coat consisting of an electrode material or a substance obtained by a reaction of the electrode material by a discharge energy on a surface of a workpiece by generating a discharge between an electrode and the workpiece in a treatment liquid or in the air using a green compact obtained by molding a metal, metal compound, or ceramic powder or other green compact obtained by heating the green compact as the electrode, includes repeating a single discharge for depositing the electrode material on the surface of the workpiece in a shape of an elliptical arc to form the coat on the surface of the workpiece.

The other objects, features, and advantages of the present invention are specifically set forth in or will become apparent from the following detailed description of the invention when read in conjunction with the accompanying drawings.

DETAILED DESCRIPTION

Exemplary embodiments of a discharge surface-treating electrode and a method of evaluating the discharge surface-treating electrode, and a discharge surface treating method according to the present invention will be explained in detail with reference to the accompanying drawings.

Functions required in a thick film formed by a discharge surface treating method according to the present invention include a wear resistance, a lubricity, and the like in a high temperature environment. The present invention is mainly applied to components used in the high temperature environment. To form such a thick film, a discharge surface-treating electrode (hereinafter, sometimes referred to simply as "electrode") obtained by compression-molding powder that mainly consists of a metallic component such as Cr or Mo and, if necessary, conducting a heat treatment to a resultant green compact is used differently from a discharge surface-treating electrode that mainly consists of ceramics for forming a hard ceramic coat exhibiting a wear resistance and the like at an ordinary temperature.

Through experiments conducted by the inventors of the present invention, it is discovered that supply of a material from an electrode side, welding of the supplied material on a surface of a workpiece, and how the supplied material is bound with the workpiece material are the most influential factors for the coat performances. As for the supply of the material from the electrode side, it is requisite to cause the electrode to have a predetermined property such as a somewhat low hardness, and to eliminate a fluctuation in the hardness of the electrode to make the hardness uniform.

The somewhat low hardness of the electrode is required because a large amount of the electrode material must be supplied to the workpiece by a discharge pulse. The hardness of the electrode must be uniform because unless it is so, the amount of the electrode material to be supplied changes according to portions of the electrode. As a result, a manner of forming the coat fluctuates and the coat with a uniform thickness cannot be formed. This requirement is a consideration item unique to the thick film formation that cannot ensure providing a uniform-thickness coat unless the electrode material in large amounts is uniformly supplied to the treated region differently from thin film formation in which the coat is hardly influenced even when the electrode hardness is not uniform to some degree.

Figure 1:
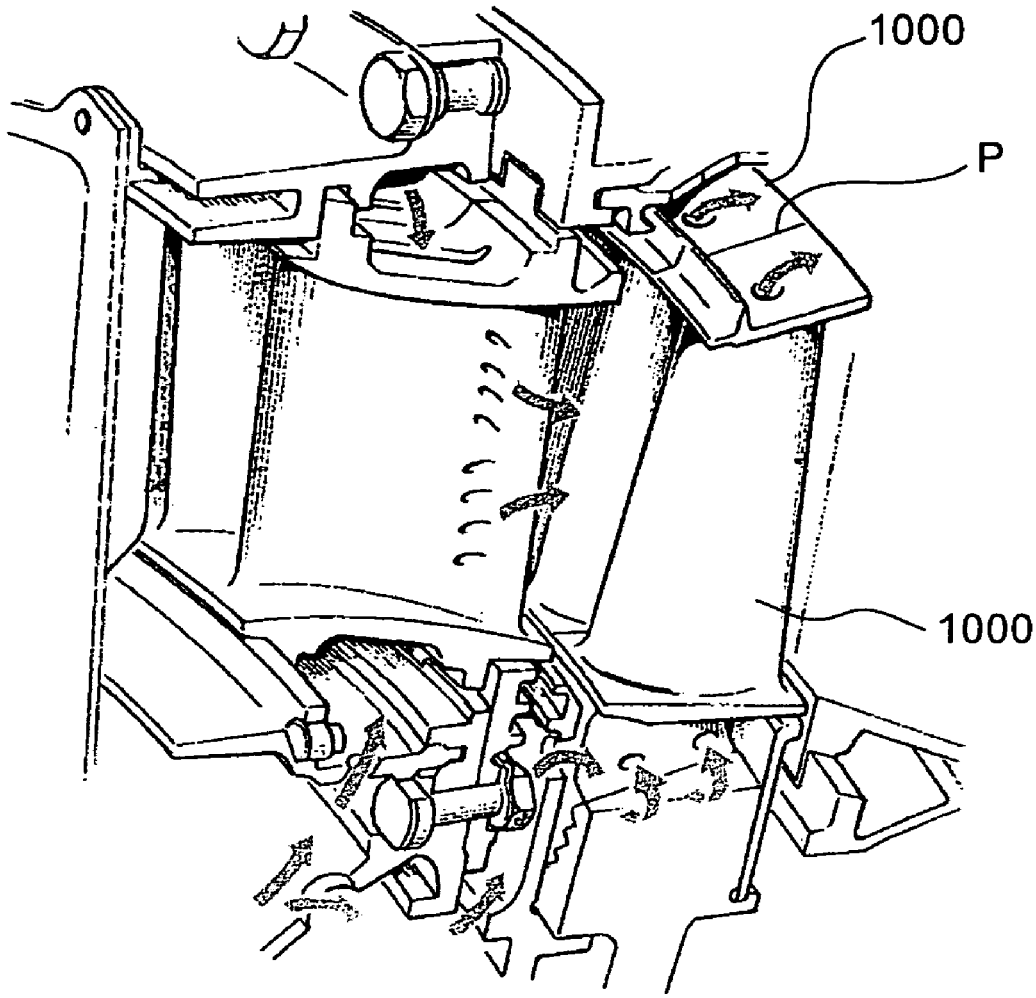
FIG. 1 is a schematic diagram of a structure of turbine blades in an aircraft gas turbine engine.
Figure 2:
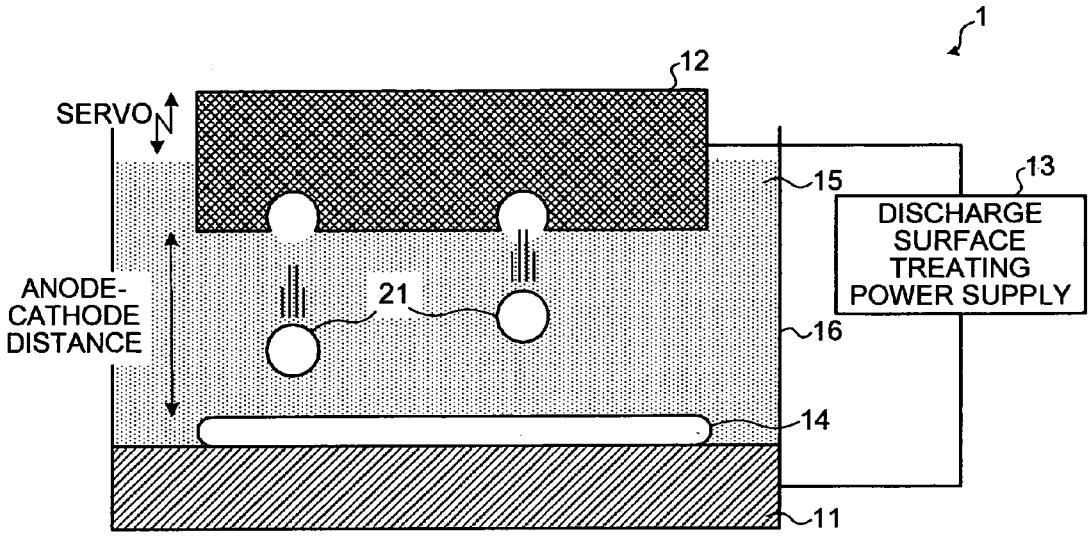
FIG. 2 is a schematic diagram of a discharge surface treatment by a discharge surface treating apparatus.

FIG. 2 is a schematic diagram of a discharge surface treatment by the discharge surface treating apparatus. A discharge surface treating apparatus 1 includes a workpiece 11 (hereinafter, "work") on which a coat 14 is to be formed, a discharge surface-treating electrode 12 for forming the coat 14 on a surface of the work 11, and a discharge surface treating power supply 13 that is electrically connected to both the work 11 and the discharge surface-treating electrode 12 and that supplies thereto a voltage for generating an arc discharge between them. If the discharge surface treatment is performed in a liquid, a treatment bath 16 is further disposed so as to fill the work 11 and a portion of the discharge surface-treating electrode 12 which portion faces the work 11 with a treatment liquid 15 such as oil. If the discharge surface treatment is performed in the air, the work 11 and the discharge surface-treating electrode 12 are disposed in a treatment atmosphere. It is noted that in FIG. 2 and the following explanation, the discharge surface treatment is performed in the treatment liquid 15 as an example. In addition, a distance between opposing faces of the discharge surface-treating electrode 12 and the work 11 is referred to as "anode-cathode distance".

The discharge surface treating method executed by the discharge surface treating apparatus 1 thus constituted will be explained. In the discharge surface treatment, the work 11 on which the coat 14 is to be formed is set as an anode. The discharge surface-treating electrode 12 obtained by compression-molding powder at an average particle diameter of several micrometers such as metal or ceramics from which the coat 14 is supplied, and by conducting a heat treatment to a resultant green compact, if necessary, is set as a cathode. Further, a discharge is generated between the anode and the cathode while a control mechanism by heat treating the (not shown) controls the anode-cathode distance so that they do not contact with each other in the treatment liquid 15.

When the discharge is generated between the discharge surface-treating electrode 12 and the work 11, a part of the electrode 21 molten by a blast or an electrostatic force caused by this discharge is separated from the electrode 12 and moved toward the surface of the work 11. The molten partial electrode 21 is resolidified to become the coat 14 when arriving on the surface of the work 11.

Figure 3:
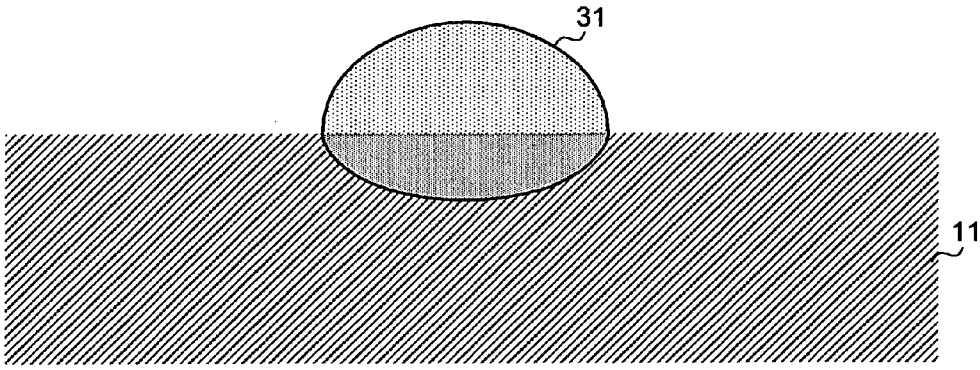
FIG. 3 depicts a shape of a trace by a single discharge if a supply amount of powder separated from an electrode is appropriate.

If a supply amount of the powder 21 separated from the electrode is appropriate, then the powder 21 separated therefrom is all molten during moving on an arc column and resolidified to become the coat 14 on the surface of the work 11. At this time, the surface of the work 11 is also molten by heat in the arc column, thereby ensuring a strong binding power between the coat 14 and the work 11. A discharge trace by a single discharge (single discharge trace) is formed. FIG. 3 depicts a shape of a discharge trace by a single discharge if the supply amount of powder separated from the electrode is appropriate. As shown in FIG. 3, if the supply amount of the powder 21 separated from the electrode is appropriate, a discharge trace 31 is in a cone shape (an ellipse) that is highest at the center of the discharge trace 31. The coat formed by accumulating discharge traces 31 resulting from the discharge is made compact.

Figure 4:
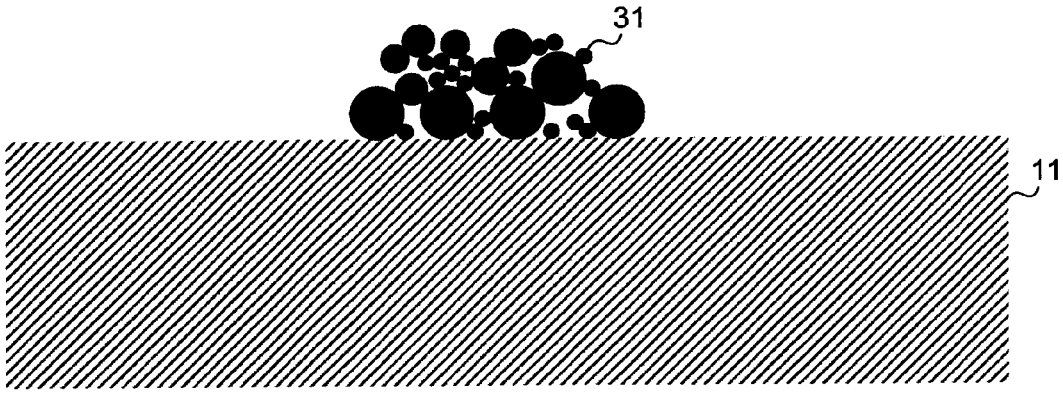
FIG. 4 depicts a shape of a trace by the single discharge if the supply amount of powder separated from the electrode is excessive.

On the other hand, if the supply amount of the powder 21 separated from the electrode is excessive, the powder 21 separated therefrom is not completely molten while being moved onto the surface of the work 11. As a result, the unmolten powder 21 separated from the electrode arrives on the work 11. A molten region is not formed on the work 11 even if the unmolten powder 21 separated from the electrode is moved onto the surface of the work 11. As a result, the powder 21 moved from the electrode is not bound with the work 11, and the resultant coat 14 is weak so that the coat 14 can be peeled off by hand. FIG. 4 depicts a shape of a discharge trace by a single discharge if the supply amount of powder separated from the electrode is excessive. As shown in FIG. 4, discharge traces 31 formed by the single discharge are in unregulated shapes, such that accumulated traces 31 are easily peeled off by an external impact.

Figure 5:
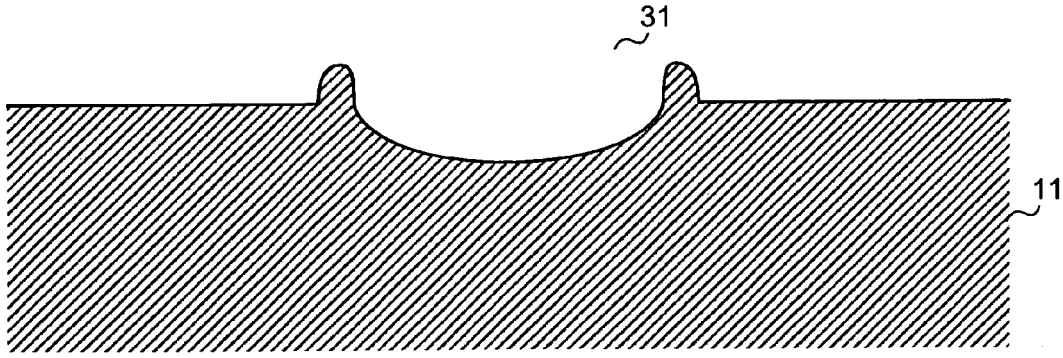
FIG. 5 depicts a shape of a trace by the single discharge if the supply amount of powder separated from the electrode is insufficient.

If the supply amount of the powder 21 separated from the electrode is insufficient, the amount of the powder 21 separated therefrom is small and a temperature of the arc column remains high. In addition, a part of the electrode material is evaporated and the powder 21 is accumulated on the work 11 only slightly (i.e., the coat is so thin that the coat cannot be observed). FIG. 5 depicts a shape of a discharge trace by a single discharge if the supply amount of powder separated from the electrode is insufficient. As shown in FIG. 5, the shape of the discharge trace 31 by the single discharge is a crater dented at a center of the discharge trace 31 and raised on a surrounding thereof. If the supply amount of the powder 21 separated from the electrode is small, then the electrode material cannot be supplied to the work 11 and the work 11 is removed.

Figure 6:
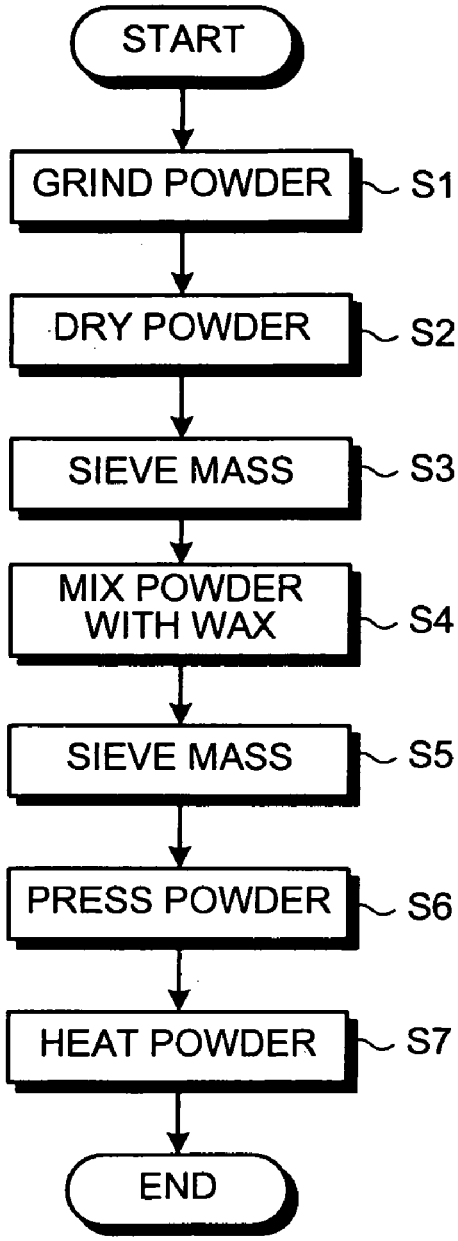
FIG. 6 is a flowchart for a manufacturing process of a discharge surface-treating electrode.

FIG. 6 is a flowchart for a manufacturing process of the discharge surface-treating electrode. First, commercially available spherical powder having an average particle diameter of several tens of micrometers and consisting of metal, metal compound, or ceramics is ground into an average particle diameter of 3 micrometers or less by a grinding machine such as a ball mill (at step S1). The powder tends to be agglomerated when being made small in size. Therefore, if the powder is to be ground down to the average particle diameter of several micrometers, the powder is normally ground in a liquid such as acetone, ethanol, water, or the like. If the powder is ground in the liquid, it is necessary to evaporate the liquid and dry the powder after the powder is completely ground (at step S2). The dried powder is agglomerated into a large mass. To break up the mass to pieces, the mass is sieved by a sieve mesh having a smaller mesh size (about 0.3 millimeter) than the anode-cathode distance (at step S3).

The process of sieving the ground powder at the step S3 will be explained. In the discharge surface treatment, a voltage applied between the discharge surface-treating electrode 12 and the work 11 to generate the discharge is normally in a range between 80 and 300 volts. If the voltage in this range is applied between the electrode 12 and the work 11, the distance between the electrode 12 and the work 11 during the discharge surface treatment is about 0.3 millimeter. As explained, the agglomerate mass constituting the electrode 12 is separated from the electrode 12 as it is by the arc discharge generated between the anode and the cathode. Assuming that a size of the mass of the electrode material separated by the discharge is larger than the anode-cathode distance (0.3 millimeter), a short circuit between the anode and the cathode occurs. By sieving the mass by the sieve mesh so that the size of the mass is made equal to or smaller than 0.3 millimeter, the agglomerate mass is prevented from being used as the electrode material as it is. As long as the size of the mass is equal to or smaller than the anode-cathode distance (0.3 millimeter), a next discharge can be generated even if the mass equal to or smaller than 0.3 millimeter in size is present between the anode and the cathode. Further, a discharge is generated between portions at a short distance. The discharge is, therefore, generated in a portion in which the mass is present, and the mass can be ground to pieces by a thermal energy or a blasting force resulting from the discharge, with less problems. Further, the electrode material that has been sieved and broken to pieces can be sufficiently mixed with a wax at a next step. Such an electrode material is, therefore, advantageous for enhancement of a moldability of the electrode.

Thereafter, in order to improve transmission of a pressure for pressing into the powder at a later pressing step, a wax such as a paraffin wax is mixed with the powder at a weight percentage of about 1% to 10% (at step S4). If the powder is mixed with the wax, the moldability can be enhanced. However, since the powder is covered with the liquid again, the powder is agglomerated into a large mass by an action of an intermolecular force or an electrostatic force. The re-agglomerate mass is sieved to break the mass to pieces (at step S5). A manner of sieving the mass is equal to that at the step S3.

The resultant powder is put into a molding machine so that the powder is formed into a predetermined shape and molded by pressing or compression molding (at step S6). The pressed powder obtained by compressing the powder is taken out from the molding machine, and heated in a vacuum furnace or a furnace in a nitrogen atmosphere (at step S7). During heating, the wax present in the electrode is evaporated and removed from inside the electrode. In addition, if the heating temperature is made higher, the electrode is harder, if the heating temperature is made lower, the electrode is softer. Further, if the particle diameter of the electrode material powder is smaller, the electrode is harder, and if the particle diameter of the electrode material powder is larger, the electrode is softer. Manufacturing of a conductive green compact electrode is thereby completed.

At the powder grinding step S1, the spherical powder of metal or ceramics at the average particle diameter of several tens of micrometers is ground into the average particle diameter of 3 micrometers or less in the liquid by the grinding machine such as the ball mill. At the drying step S2, the liquid is dried. However, if the powder at the average particle diameter of 3 micrometers or less is commercially available, the grinding step S1 and the drying step S2 can be omitted. Examples of the commercially available powder at the average particle diameter of 3 micrometers or less include Co, Ni, or alloys thereof that are hard to oxidize, oxides, ceramics, and the like. If powder having a high moldability is used, then it is unnecessary to mix the powder with the wax at the mixing step S4, and the sieving step S5 can be omitted.

For reference, even if the grinding step S1 is omitted and the powder at the average particle diameter of, for example, several tens of micrometers is used without processing it, the discharge surface-treating electrode can be molded. However, the electrode is unfavorable because of a hardness fluctuation, i.e., a high hardness of an electrode surface and a low hardness of a central portion. That is, such an electrode is not suited for the thick film formation.

The fluctuation in the hardness of the electrode occurs for the following reasons. Normally, when the powder is press-molded, a pressure is transmitted from the powder in contact with a pressed surface or a mold surface toward an interior of the electrode, and the powder is slightly moved. At this moment, if the average particle diameter of the powder is as large as about several tens of micrometers, a large space is formed between the powders. The powder in contact with the pressed surface or the mold surface (the powder on the electrode surface) is moved to fill up the space, a particle density on the electrode surface increases, and a friction thereon increases. Namely, if the powder is large, then a reactive force to the pressing pressure can be retained only by the electrode surface, and the pressure is not transmitted to the interior of the electrode. As a result, a hardness distribution exists in the electrode.

According to a first embodiment of the present invention, an example of manufacturing an electrode using commercially available Co powder at an average particle diameter of 1 micrometer will be explained. The electrode is manufactured according to the flowchart shown in FIG. 6. Considering that the Co powder has high moldability, the powder is molded by a predetermined pressure for pressing without using wax, the resultant pressed powder is heated in the vacuum furnace for 1 hour, and an electrode having a size of $\phi$18.2 millimeters×30.5 millimeters is manufactured. To compare electrode performances, electrodes are manufactured by heating the pressed powder at heating temperatures of 100° C., 300° C., and 350° C., respectively.

A result of performing the discharge surface treatment using the electrode manufactured at the heating temperature of 300° C. is shown as an example. In this example, while assuming that an electrode side is a cathode and a work side is an anode, continuous discharges are generated under discharge pulse conditions of various combinations such as a peak current ie of 5 to 20 amperes and a discharge duration (a discharge pulse width) te of 4 to 100 microseconds. In addition, an actual processing is performed for 5 minutes. Under these discharge pulse conditions, the size (diameter) of the discharge trace changes according to the discharge pulse conditions but the shape of the discharge trace remains an elliptical arc shape. Namely, the discharge trace is changed analogously to the peak current and the discharge duration. In other words, the electrode manufactured at the heating temperature of 300° C. can be subjected to an accumulation processing without influence of the processing conditions (discharge pulse conditions).

Figure 7:
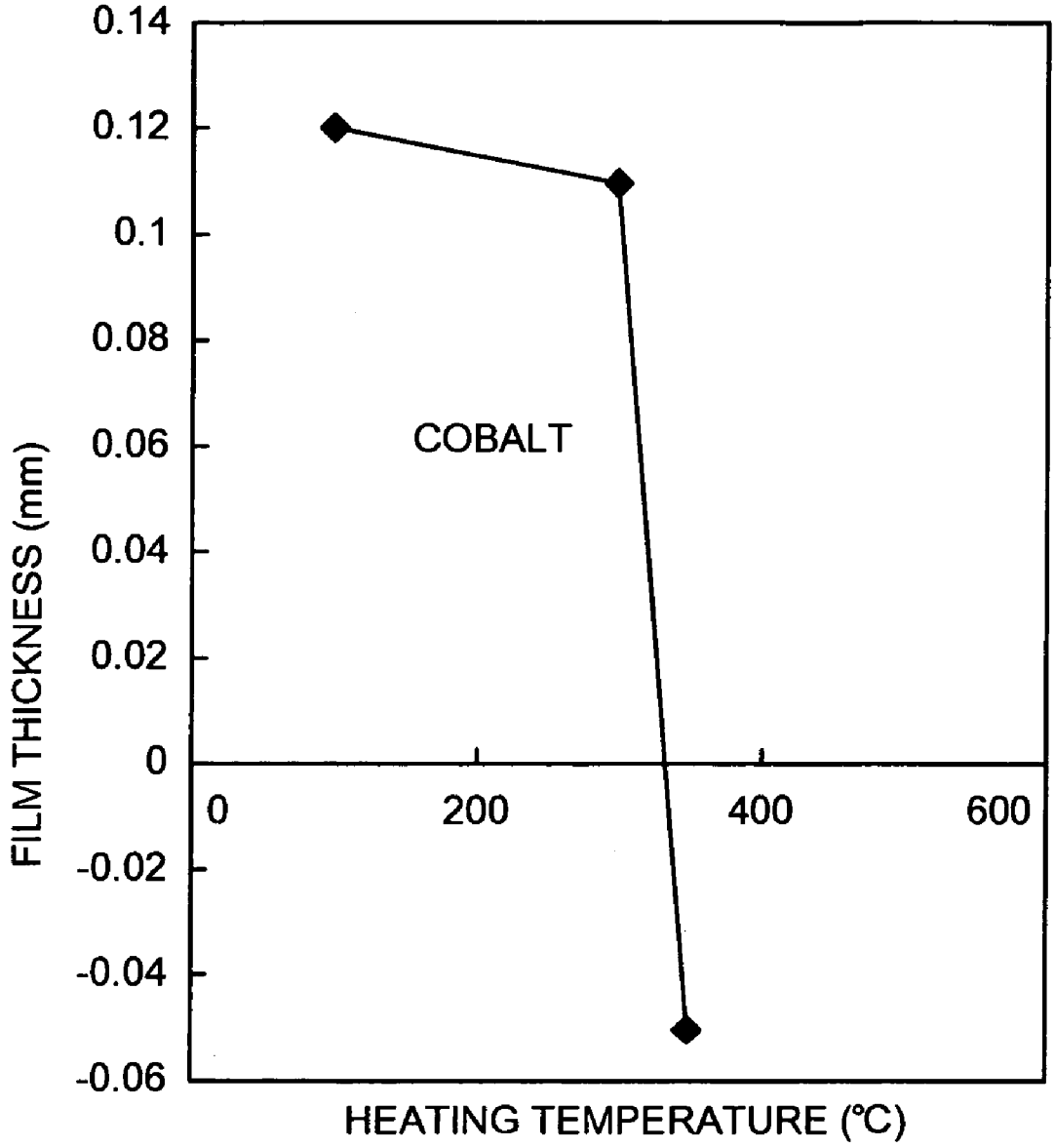
FIG. 7 depicts a relationship between a coat thickness and a heating temperature of the discharge surface-treating electrode.

FIG. 7 depicts a relationship between a coat thickness and the heating temperature of the discharge surface-treating electrode at the peak current ie of 12 amperes and the discharge duration (discharge pulse width) te of about 4 microseconds. In the drawing, a horizontal axis indicates the heating temperature (° C.) at which the discharge surface-treating electrode is heated, and a vertical axis indicates the thickness (millimeters) of the coat formed on the work surface if the discharge surface treatment is performed using the discharge surface-treating electrode that has been subjected to the heat treatment at the heating temperature indicated by the horizontal axis. As indicated by a cobalt-related result shown in the drawing, if the heating temperature during manufacturing of the electrode is 100° C. or 300° C., the coat having a film thickness of about 0.1 millimeter can be formed on the work surface (an accumulation processing can be performed). If the heating temperature during manufacturing of the electrode is 350° C., no coat is formed on the work surface, resulting in a removal processing of shaving the work.

Figure 8:
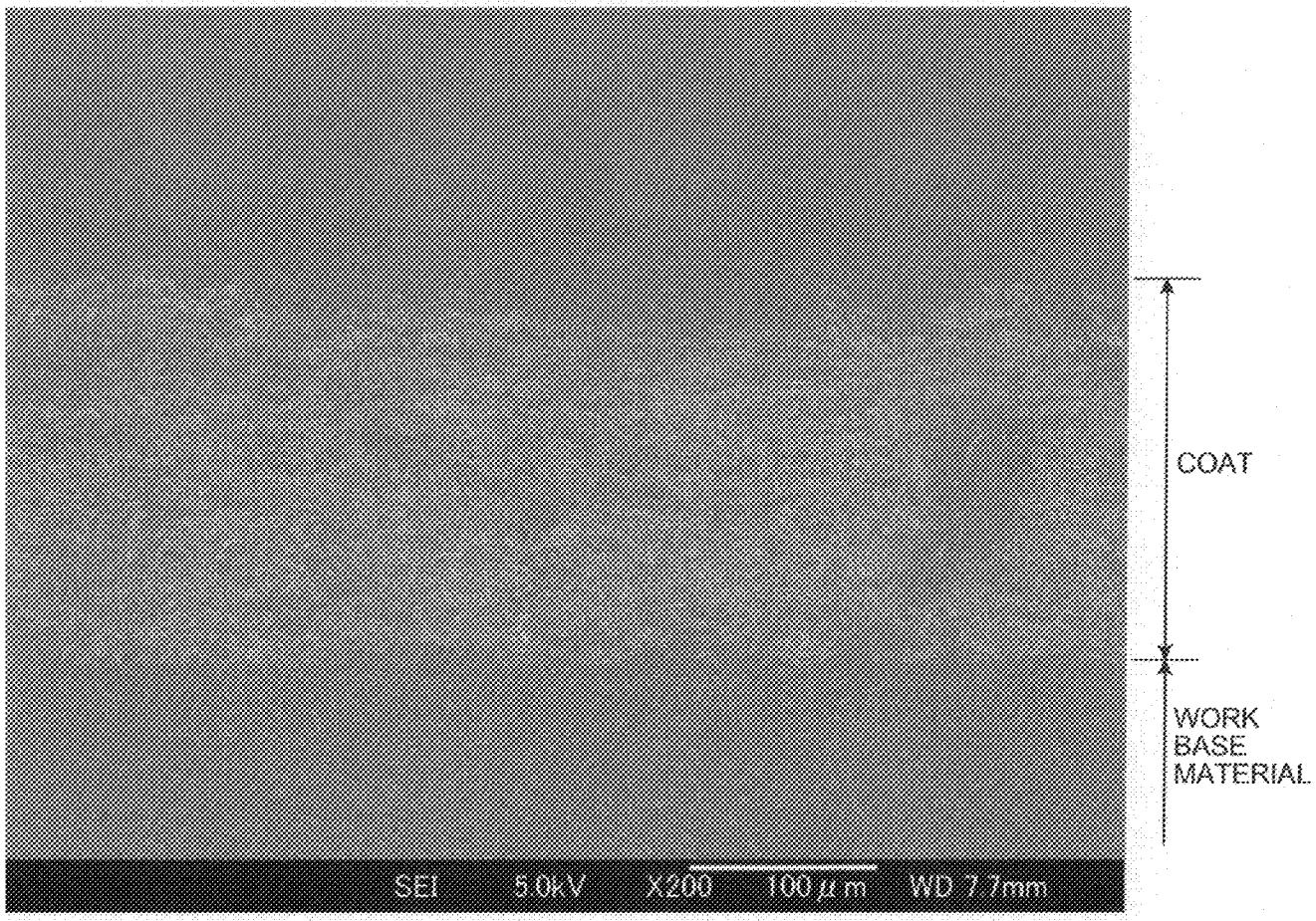
FIG. 8 is a scanning electron microscope (SEM) photograph of a cross-section of a coat formed by the discharge surface treatment using the electrode manufactured at the heating temperature of 300° C.

States of the coats formed by the discharge surface treatment using the electrodes manufactured at the heating temperatures of 100° C. and 300° C., respectively, will be considered. The coat formed by the electrode manufactured at the heating temperature of 100° C. is peeled off when rubbed by hand. The coat formed by the electrode manufactured at the heating temperature of 300° C., by contrast, is formed by accumulating the discharge traces shown in FIG. 3 and is made compact, as explained. FIG. 8 is an SEM (Scanning Electron Microscope) photograph of a cross-section of the coat formed by the discharge surface treatment using the electrode manufactured at the heating temperature of 300° C. As shown in the drawing, the coat formed on the work is a compact coat without pores.

Thus, in order to form the compact coat by the discharge surface treatment using the discharge surface-treating electrode manufactured from the Co power at the average particle diameter of 1 micrometer, it is effective to use the electrode manufactured under conditions so that every single discharge trace is in the elliptical arc shape, that is, to use the discharge surface-treating electrode obtained by pressing the Co powder and then heating the pressed Co powder at 300° C.

According to the first embodiment, it is possible to determine whether the discharge surface-treating electrode is an electrode that can form the compact thick film based on the shape of the single discharge trace. If the Co powder has the average particle diameter of 1 micrometer, the compact thick film can be formed by heating the pressed powder obtained by compression-molding the powder at 300° C.

If the material or the size of the powder for the discharge surface-treating electrode is changed, then it is necessary to manufacture electrodes under various manufacturing conditions, actually form coats by the discharge surface treatment using the respective electrodes manufactured, and evaluate whether each of the electrodes can form the compact thick coat so as to obtain manufacturing conditions for the electrode for forming a compact thick coat. This takes considerable labor and time.

Further, even if an electrode is manufactured using the powder of the same material by the same manufacturing method, a volume of a powder aggregate differs according to seasons (temperatures and humidities). For this reason, similarly to when the material or the size of the powder is changed, it is necessary to actually form coats by the discharge surface treatment using the respective electrodes manufactured, and evaluate the electrodes. If the electrodes are manufactured each by using 30 grams of powder of the same material and by pressing the powder using a mold of a size of ϕ18.2 millimeters×30.5 millimeters, for example, a pressure for pressing differs between summer and winter.

According to a second embodiment of the present invention, therefore, a method for evaluating discharge surface-treating electrodes manufactured under various conditions, with which method it is possible to determine whether the respective discharge surface-treating electrodes can form compact coats without the need of performing processings performed until the coat formation for the discharge surface-treating electrodes will be explained.

A principle of the method for evaluating the discharge surface-treating electrode according to the second embodiment will first be explained. The method for evaluating the discharge surface-treating electrode according to the second embodiment is to evaluate the discharge surface-treating electrode by observing a state of a single discharge trace using the fact that the coat is formed by accumulating single discharge traces by a single-pulse discharge. Namely, a shape of each single discharge trace when a compact coat can be formed and that of each single discharge trace when a compact coat cannot be formed are obtained. In addition, single discharge traces formed using various electrodes manufactured are observed, thereby determining whether the respective electrodes can form compact coats. Specifically, if the shape of the single discharge trace is a shape with which the compact coat can be formed, it is also determined that the coat formed by accumulating these single discharge traces is made compact. The "shape of the single discharge trace with which the compact coat can be formed" means that a side surface shape of a single discharge trace is the elliptical arc shape shown in FIG. 3 according to the first embodiment. The "shape of the single discharge trace with which the compact coat cannot be formed" refers to the shape of the single discharge trace shown in FIGS. 4 and 5.

The method for evaluating the discharge surface-treating electrode will be explained with specific examples. Commercially available Co powder at the average particle diameter of 1 micrometer is molded at a predetermined pressure for pressing without using a wax, the pressed powder is heated for 1 hour in the vacuum furnace, and an electrode at a size of ϕ1 millimeter×10 millimeters is manufactured. To compare electrode performances, electrodes are manufactured at heating temperatures of 100° C., 300° C., and 350° C., respectively.

The result of performing the discharge surface treatment using the electrode manufactured at the heating temperature of 300° C. is shown, similarly to the first embodiment. In this case, while assuming that the electrode side is a cathode and the work side is an anode, a single-pulse discharge is generated under discharge pulse conditions of various combinations such as the peak current ie of 5 to 20 amperes and the discharge duration (discharge pulse width) te of 4 to 100 microseconds. Under these discharge pulse conditions, the size (diameter) of the discharge trace changes according to the discharge pulse conditions but the shape of the discharge trace remains the elliptical arc shape. Namely, the discharge trace is changed analogously to the peak current and the discharge duration. In other words, the electrode which can form the elliptical arc-shaped discharge trace by the single discharge is not influenced by processing conditions (discharge pulse conditions).

Figure 9:
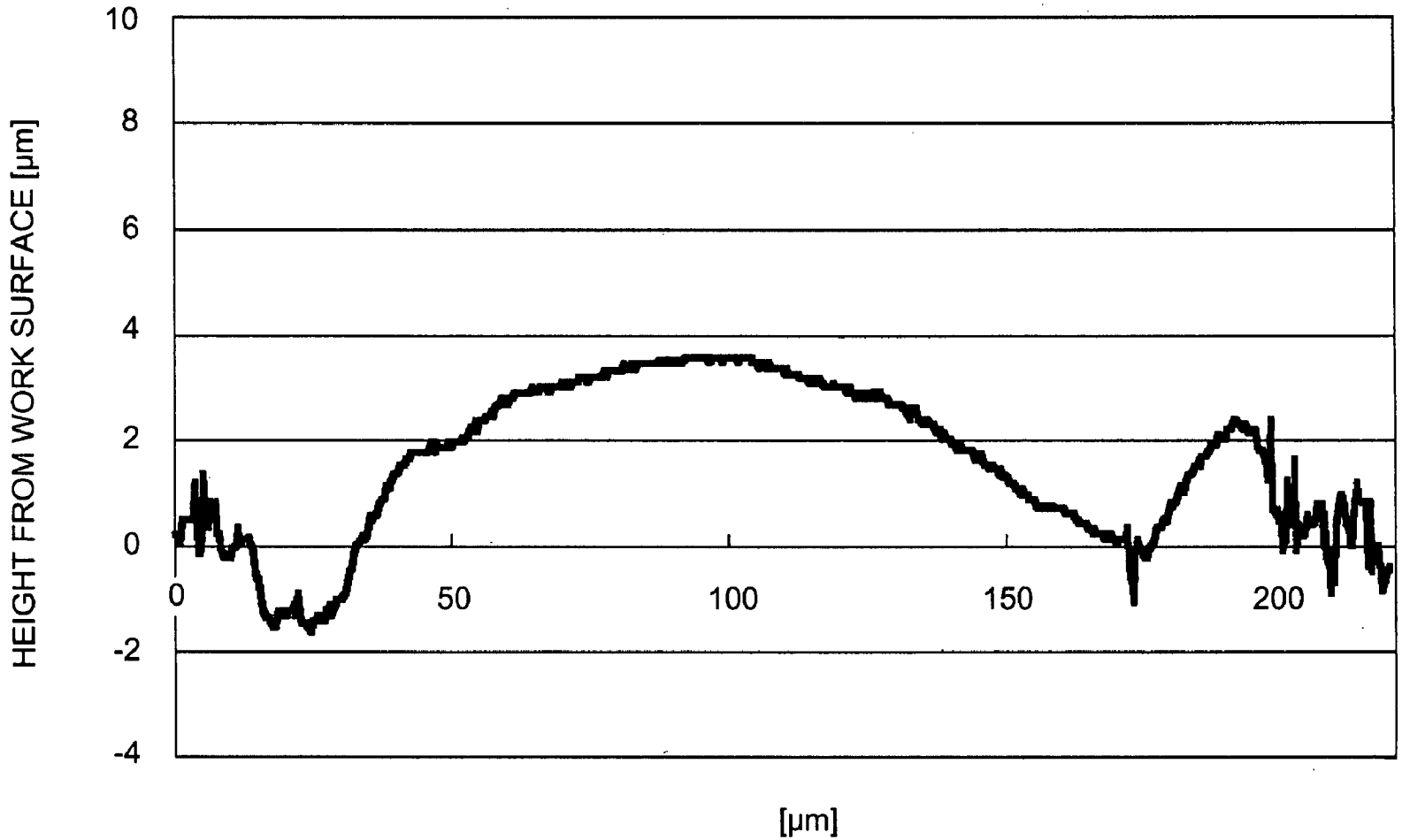
FIG. 9 depicts a result of measuring the shape of the single discharge trace using a three-dimensional laser microscope if the discharge surface treatment is performed using the electrode manufactured at the heating temperature of 300° C.

FIG. 9 depicts a result of measuring the shape of the single discharge trace by a three-dimensional laser microscope if the discharge surface treatment is performed at the peak current ie of 12 amperes and the discharge duration (discharge pulse width) te of about 64 microseconds. As shown in the drawing, the single discharge trace formed if the discharge surface treatment is performed under these discharge pulse conditions using the electrode manufactured at the heating temperature of 300° C. is in a cone shape that is high at the center, which shape is similar to the elliptical arc shape shown in FIG. 3.

If the discharge surface treatment is performed under the discharge pulse conditions using the electrode manufactured at the heating temperature of 100° C., the coat is formed on the surface of the work by accumulating the discharge traces. However, the coat is peeled off when rubbed by hand. As a result, the discharge traces are removed and the shape of the discharge traces cannot be observed.

Figure 10:
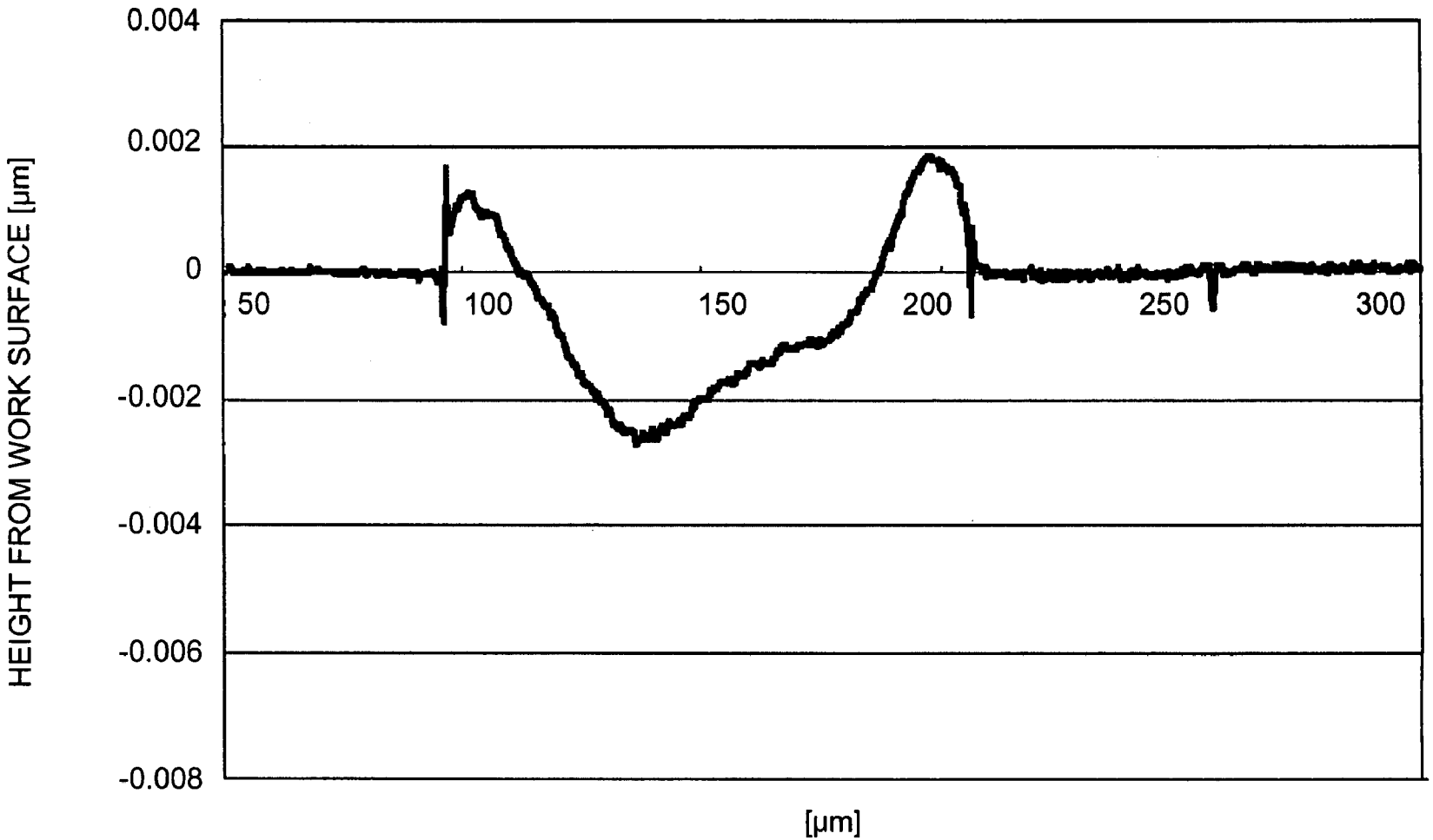
FIG. 10 depicts a result of measuring the shape of the single discharge trace using a three-dimensional laser microscope if the discharge surface treatment is performed using the electrode manufactured at a heating temperature of 350° C.

FIG. 10 depicts a result of measuring the shape of the single discharge trace by the three-dimensional laser microscope if the discharge surface treatment is performed at the peak current ie of 12 amperes and the discharge duration (discharge pulse width) te of about 64 microseconds using the electrode manufactured at the heating temperature of 350° C. As shown in the drawing, the single discharge trace formed if the discharge surface treatment is performed under these discharge pulse conditions using the electrode manufactured at the heating temperature of 350° C. is in the shape of a crater dented at the center and raised on the surrounding, which shape is similar to that shown in FIG. 5.

The following relationship is discovered between the processings performed until the coat is formed according to the first embodiment and the single discharge traces according to this second embodiment. To form the compact coat, it is necessary to accumulate the single discharge traces, and it is, therefore, important to select the electrode with which the state of the single discharge traces is a state in which the single discharge traces are accumulated in an elliptical arc fashion. Namely, if the electrode which can accumulate by the single discharges is used, the compact coat can be formed by accumulating the accumulated single discharges.

The method for evaluating the discharge surface-treating electrode according to the second embodiment will be explained. In this second embodiment, electrodes manufactured with varied paraffin (wax) amounts, pressures, and heating temperatures during manufacturing of the electrodes, and having surfaces each at a diameter of about ϕ1 millimeter are manufactured by the method explained above, respectively. The size of the arc column on the surface of the electrode serving as the cathode when the discharge is generated is about ϕ0.3 millimeter at most. It, therefore, suffices that the electrode is about 1 millimeter. Using each of these small electrodes, a discharge is generated with respect to the work only once.

Figure 11:
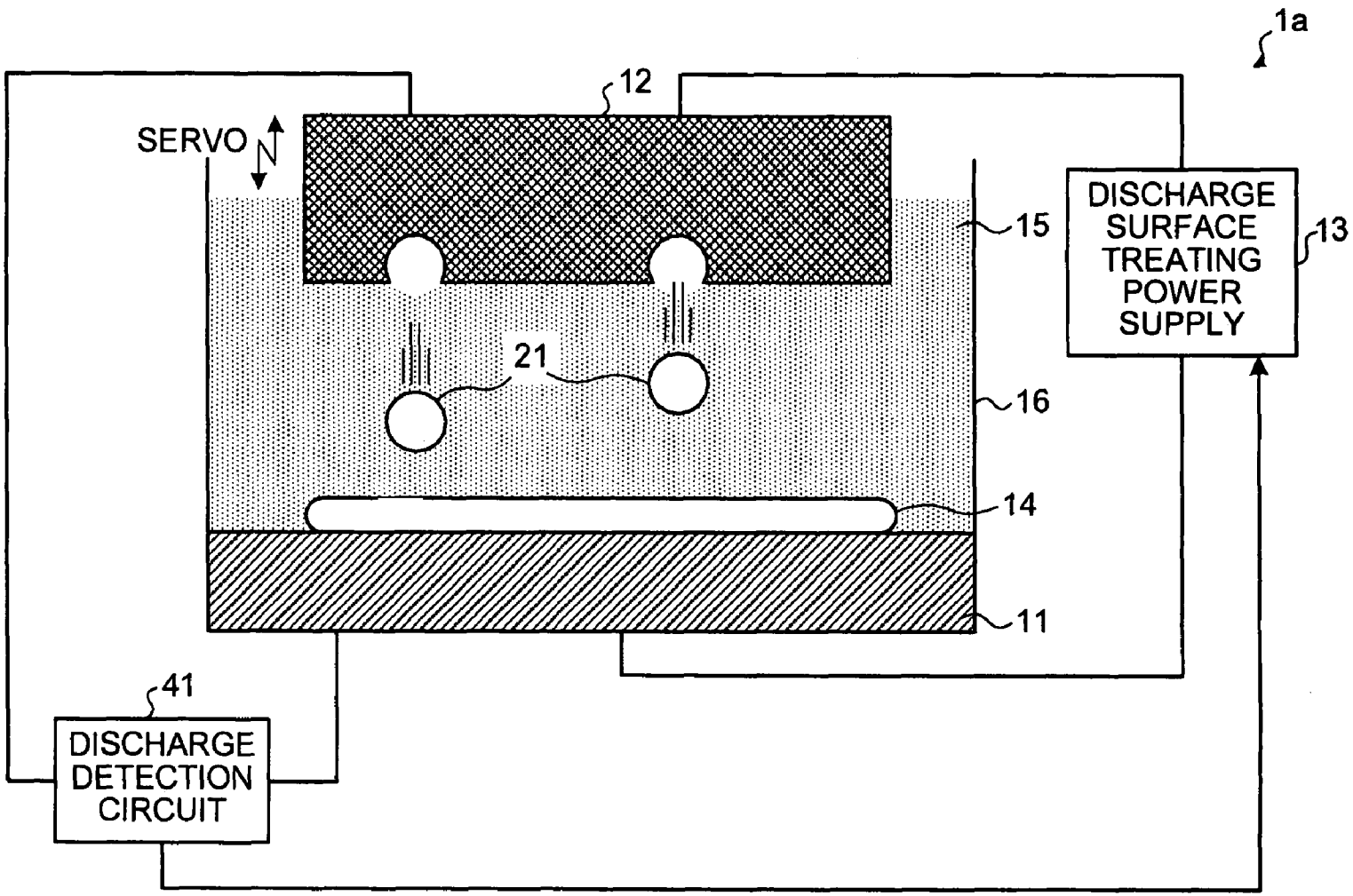
FIG. 11 is a schematic block diagram of the discharge surface treating apparatus used for a method for evaluating the discharge surface-treating electrode.

FIG. 11 is a schematic block diagram of the discharge surface treating apparatus used for the method for evaluating the discharge surface-treating electrode according to the second embodiment. A discharge surface-treating electrode 1*a* includes a discharge detection circuit 41 that detects generation of a discharge between the discharge surface-treating electrode 12 and the work 11 as well as the same constituent elements as those of the discharge surface-treating electrode according to the first embodiment shown in FIG. 2. Like reference numerals designate like parts as those shown in FIG. 2 and redundant explanation is omitted.

The discharge detection circuit 41 detects generation of a discharge so as to generate only one discharge between the electrode 12 and the work 11. The discharge detection circuit 41 is constituted to transmit a 5-volt signal to the discharge surface treating power supply 13 when voltage between the anode and the cathode is detected and a voltage applied just before the discharge is started is equal to or lower than 50 volts. In addition, the discharge surface treating power supply 13 stops applying the voltage between the anode and the cathode when receiving the signal from the discharge detection circuit 14.

With this configuration, the voltage applied between the anode and the cathode suddenly decreases from about 80 volts to about 20 volts when the discharge is started. The discharge detection circuit 41 detects this voltage drop and transmits the 5-volt signal to the discharge surface treating power supply 13. When receiving this signal, the discharge surface treating power supply 13 stops applying the voltage between the anode and the cathode. In this way, it is possible to generate the single discharge.

After generating the single discharge between the anode and the cathode, the shape of the discharge trace (single discharge trace) formed on the work 11 is observed by an observation unit such as a microscope. In addition, the supply amount (accumulation amount) of the electrode material supplied from the electrode 12 is grasped by a curve approximation or an integration processing. For the cross-sectional shape of the discharge trace, for example, curve approximations from a conicoid curve approximation to a sextic curve approximation are performed, and equations of these approximated curves are integrated with 360 degrees, thereby calculating the accumulation amount of the electrode material accumulated on the work 11. It is thereby possible to evaluate whether each electrode can form the compact coat by the single discharge.

In this example, the accumulation amount of the electrode material on the work 11 by the single discharge is calculated. Alternatively, whether each electrode can form the compact coat may be evaluated based only on the shape of the single discharge trace without calculating the accumulation amount. This is because the shape of the single discharge trace which enables forming the compact coat is limited to the elliptic arc shape shown in FIG. 3. Thus, after discovering the discharge trace having the shape as shown in FIG. 3 from the results of generating the single discharges using the respectively manufactured electrodes 12, an electrode to be actually used may be manufactured under the same conditions as those for the electrode 12.

According to the second embodiment, a small electrode is manufactured first, and it is possible to then grasp whether the electrode can form the compact coat by the single discharge traces by the single discharge using this electrode. If the coat is actually formed and it is evaluated whether the electrode can form the compact coat, it takes some time (5 to 15 minutes) to form the coat. According to the second embodiment, by contrast, the single discharge is finished momentarily, and it is possible to promptly evaluate whether the electrode is an optimum for forming the compact coat only by observing the shape of the single discharge trace. Electrode manufacturing efficiency can be, therefore, improved.

Furthermore, in order to determine whether the actually formed coat is compact, it is necessary to observe the cross-section of the coat formed on the work by a stereoscope or an electron microscope. According to the second embodiment, it is possible to instantly evaluate whether the electrode is an optimum electrode only by grasping the shape of the discharge trace by the single discharge on the surface using the laser microscope and determining whether the shape is of the single discharge trace that can form a compact coat. Namely, it is unnecessary to perform a breaking processing on the work in order to obtain the cross-section of the work. Besides, it suffices that the electrode used for the evaluation has an area so that an arc column can be generated, and that the evaluation electrode is small. It is thereby possible to suppress the manufacturing cost and the material cost for the electrode. Obviously, the electrode of the size to be actually used may be manufactured from the beginning, the single discharge may be generated using the electrode, and whether the electrode can form the compact coat may be determined based on the discharge trace.

According to a third embodiment of the present invention, an example of conducting an experiment using a different electrode material from that used in the second embodiment will be explained. As the electrode material, an alloy powder consisting of 28 wt % of Mo, 17 wt % of Cr, 3 wt % of Si (silicon), and a remaining weight percentage of Co is used. Alternatively, an alloy powder consisting of 28 wt % of Cr, 5 wt % of Ni, 19 wt % of W (tungsten), and a remaining weight percentage of Co, an alloy powder consisting of 25 wt % of Cr, 10 wt % of Ni, 7 wt % of W, 0.5 wt % of C (carbon), and a remaining weight percentage of Co, or the like may be used instead of the above alloy powder consisting of the above weight percentage.

The discharge surface-treating electrode is manufactured using the alloy powder according to the flowchart shown in FIG. 6. At the powder grinding step S1, the alloy powder having the composition explained above is ground by a bead mill. The bead mill is a machine in which 1.7 kilograms of balls (beads) at a diameter of ϕ1 millimeter are put between a grinding container and a rotor, and a stirring pin attached to the rotor is rotated to move the balls at a high velocity, thereby grinding the powder. To avoid aggregation by mutual binding of powders, the electrode powder is mixed with acetone or ethanol. This mixture is passed through a region, in which the balls are stirred, to grind the powder between the balls, thereby reducing the powder in size. The bead mill is constituted so that the mixture is temporarily emitted to the outside of the grinding container but returned into the container, and so that the mixture circulates in the grinding region of the bead mill a number of times. The powder is ground for 6 hours with the rotor rotated at a circumferential speed of 10 m/s.

Figure 12:
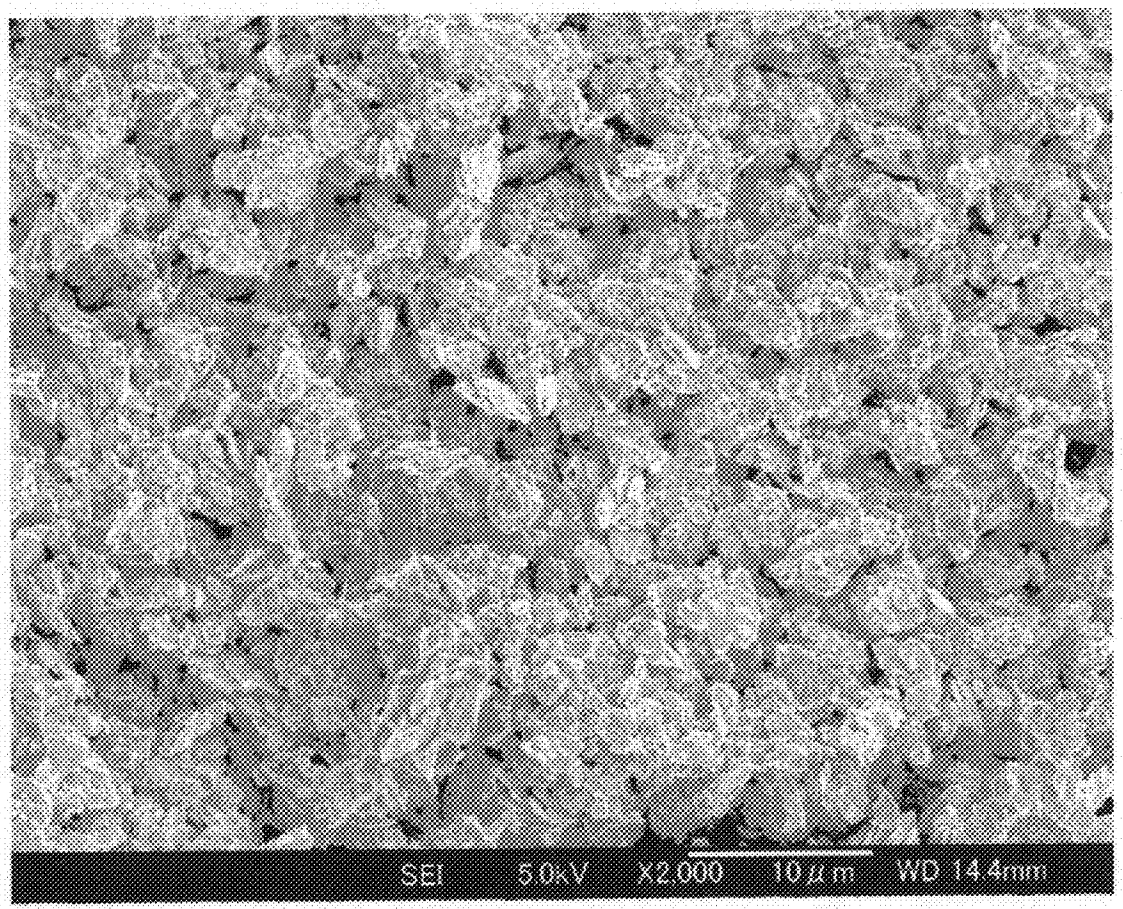
FIG. 12 is an SEM photograph of an alloy powder after being ground by a bead mill.

FIG. 12 is an SEM photograph of the alloy powder after being ground by the bead mill under the above conditions. As shown in this photograph, the powder ground by the bead mill is in a scaly shape at an average particle diameter of about 0.7 micrometer.

Alternatively, a vibration mill in which a material to be ground, balls, and a solvent are put into a container and vibrated, thereby reducing the powder in size, or a planetary ball mill in which a material to be ground, balls, and a solvent are put into a rotatable container, and in which a base on which the container is mounted is rotated together with the container, thereby reducing the material in size may be used instead of the bead mill. Even if one of these machines is used, the powder is ground into the same shape as that of the powder ground by the bead mill. It is noted, however, that a grinding force of the bead mill is ten times or more as high as that of the vibration mill since the bead mill grinds the powder using small balls (beads). A particle size distribution of the powder ground by the bead mill is, therefore, sharper and narrower than that of the powder ground by the vibration mill. If the powder having such a particle size distribution is used for the electrode, then the powder is entirely molten under the same discharge conditions, and a compactness of the coat is, therefore, further enhanced.

At the sieving step S3 shown in FIG. 6, the powder is sieved by a sieve mesh having a mesh size of 0.01 to 0.1 millimeter. At the mixing step S4 of mixing the wax with the powder, the wax is mixed at a weight percentage of 10% with the powder. At the sieving step S5, the mixture is sieved by a sieve mesh having a mesh size of 0.1 to 1 millimeter. At the heating step S7, the powder is heated for 1 hour in the vacuum furnace. The shape of the manufactured electrode has a size of ϕ18 millimeters×30 millimeters. To compare electrode performances, electrodes are manufactured at heating temperatures of 600° C., 700° C., and 800° C., respectively.

Using each of the manufactured electrodes, one discharge is generated with respect to the work consisting of INCONEL718 (Ni alloy), and a single discharge trace formed by the discharge is observed. As a result, a shape of the single discharge trace formed by the electrode manufactured at the heating temperature of 600° C. is equal to that shown in FIG. 4. A shape of the single discharge trace formed by the electrode manufactured at the heating temperature of 700° C. is equal to that shown in FIG. 3. A shape of the single discharge trace formed by the electrode manufactured at the heating temperature of 800° C. is equal to that shown in FIG. 5. It is obvious that the electrode manufactured at the heating temperature of 700° C. can best form the compact coat.

Therefore, an instance of generating continuous discharges and processing the powder for 5 minutes using the electrode manufactured at the heating temperature of 700° C. is considered in more detail. While assuming that the electrode side is a cathode and the work side is an anode, continuous discharges are generated under discharge pulse conditions of various combinations such as the peak current ie of 5 to 20 amperes and the discharge duration (discharge pulse width) te of 4 to 100 microseconds. Under these discharge pulse conditions, the size (diameter) of the discharge trace changes according to the discharge pulse conditions but the shape of the discharge trace remains the elliptical arc shape similarly to the single discharge. Namely, the discharge trace is changed analogously to the peak current and the discharge duration. In other words, the electrode which can form the elliptical arc-shaped discharge trace by the single discharge is not influenced by processing conditions (discharge pulse conditions).

Figure 13:
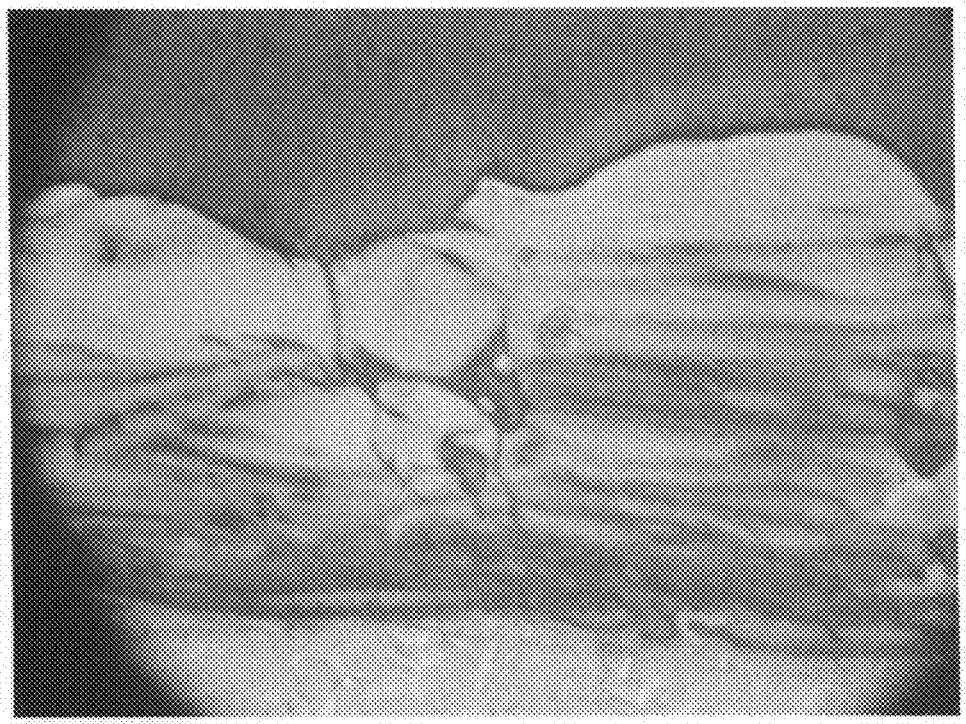
FIG. 13 is a photograph of a cross-section of a coat formed by the electrode at 700° C.

If the discharge surface treatment is performed at the peak current ie of 12 amperes and the discharge duration (discharge pulse width) te of about 8 microseconds using the electrode manufactured at the heating temperature of 700° C. which can accumulate discharge traces by the single discharge, the accumulation processing is performed. FIG. 13 is a photograph of a cross-section of a coat formed by the electrode manufactured at the heating temperature of 700° C. As shown in the drawing, the compact coat without pores is formed.

If the discharge surface treatment is performed at the peak current ie of 12 amperes and the discharge duration (discharge pulse width) te of about 8 microseconds using the electrode manufactured at the heating temperature of 600° C. which can accumulate discharge traces by the single discharge, then the coat is formed on the surface of the work and the accumulation processing is performed. However, this coat is peeled off when rubbed by hand. In addition, if the discharge surface treatment is performed using the electrode manufactured at the heating temperature of 800° C. with which the accumulation amount can be hardly recognized by the single discharge, the removal processing is performed.

According to the third embodiment, it is discovered that even if the electrode material other than the Co powder used in the example of the second embodiment is used to form the electrode that can form the single discharge traces in the elliptical arc shape, and the electrode is used similarly to the second embodiment, the compact coat can be accumulated on the work in the actual processing.

In the second and the third embodiments, the examples in which the electrode is manufactured using the Co powder at the average particle diameter of 1 micrometer or the powder reduced in size to the average particle diameter of 0.7 micrometer from the alloy powder, and the single discharge is generated, thereby forming the discharge traces on the work are explained. However, the supply amount of the electrode material by the single discharge does not depend on the material or composition of the electrode. It is, therefore, possible to evaluate whether the electrode can accumulate the thick coat by the single discharge using other metal materials.

According to a fourth embodiment of the present invention, an example in which an electrode shape and a current waveform differ from those explained in the first to the third embodiments will be explained.

In the fourth embodiment, the electrode is manufactured using an alloy powder according to the flowchart shown in FIG. 6. The composition of the alloy powder is the same as that explained in the third embodiment. The respective steps will be explained in detail. At the powder grinding step S1, the alloy powder at an average particle diameter of 6 micrometers is ground until the powder has an average particle diameter of 1.2 micrometers by the ball mill. At the grinding step, the alloy powder is mixed with acetone serving as a solvent, and a resultant mixture is ground using zirconia balls. It is noted, however, that stearic acid is dissolved into the acetone so as to suppress aggregation of powders.

At the drying step S2, the acetone is volatilized in an atmospheric-air atmosphere at about 30° C. At this moment, if the powder is completely dried, the oxidization of the powder is accelerated. To avoid this, the drying step is finished while the powder is slightly wet. In addition, to dry the powder uniformly, the powder is continuously stirred during drying. Unless stirred, the powder near the surface is dried faster than that near the bottom, resulting in the oxidization of the powder. At the mixing step S4 of mixing the wax with the powder, the paraffin wax is mixed at a weight percentage of about 1 to 10% with the dried powder.

At the sieving step S5, the powder mixed with the paraffin wax is put on a sieve mesh having a mesh size of 100 to 500 micrometers, vibrated thereon, and passed through the sieve mesh. At the pressing step S6, 10 grams of powder that has been passed through the sieve mesh is put into a mold of 50 millimeters×11 millimeters, a pressure of 50 to 100 megapascals is applied to the surface of the electrode, and the powder is pressed. As a result, a green compact of 50 millimeters×11 millimeters×5.5 millimeters is obtained.

At the heating step S7, the green compact thus obtained is put into the vacuum furnace and subjected to a heat treatment with the heating temperatures set at 730° C. and 750° C. The green compact is retained at these temperatures for about 1 hour, and then subjected to self-cooling. When the green compact is cooled, the atmospheric air is introduced into the vacuum furnace and the vacuum furnace is then opened, whereby a conductive electrode is obtained.

Using the electrode thus manufactured, one discharge is generated with respect to the work consisting of SKD61 (composition name). At this moment, the electrode side is set as the cathode and the work side is set as the anode, and the discharge surface treatment is performed. Treatment conditions are the peak current le of 10 amperes and the discharge duration (discharge pulse width) te of 4 microseconds.

Figure 14:
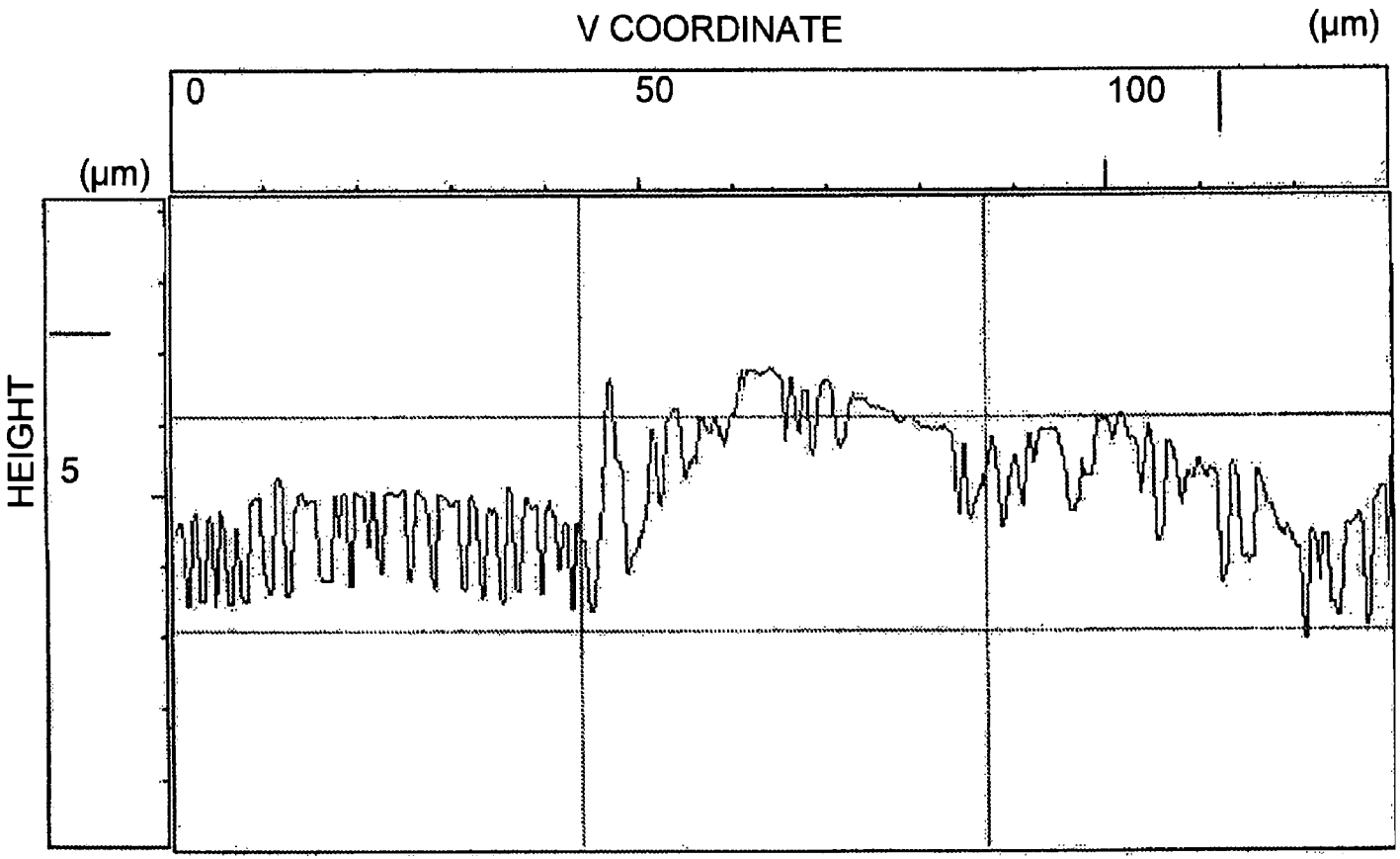
FIG. 14 depicts a result of measuring a shape of a single discharge trace if the single discharge is generated by an electrode manufactured at the heating temperature of 730° C.
Figure 15:
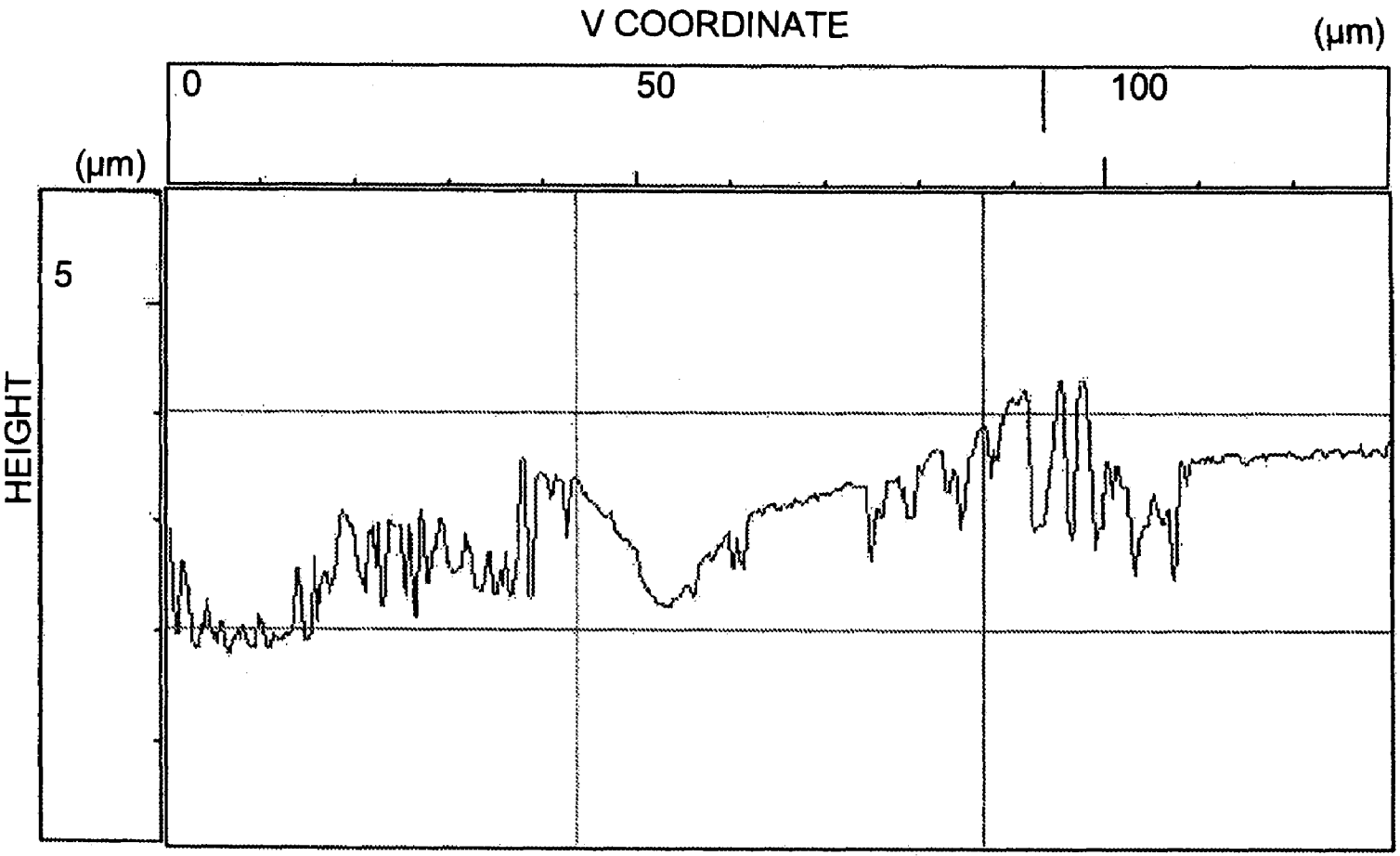
FIG. 15 depicts a result of measuring a shape of a single discharge trace if the single discharge is generated by an electrode manufactured at the heating temperature of 750° C.

FIG. 14 depicts a result of measuring a shape of a single discharge trace if the single discharge is generated by an electrode manufactured at the heating temperature of 730° C. FIG. 15 depicts a result of measuring a shape of a single discharge trace if the single discharge is generated by an electrode manufactured at the heating temperature of 750° C. The shape of the single discharge trace by the electrode manufactured at the heating temperature of 730° C. shown in FIG. 14 is an elliptical arc similar to that shown in FIG. 9. The shape of the single discharge trace by the electrode manufactured at the heating temperature of 750° C. shown in FIG. 15 is a crater similar to that shown in FIG. 10.

Figure 16:
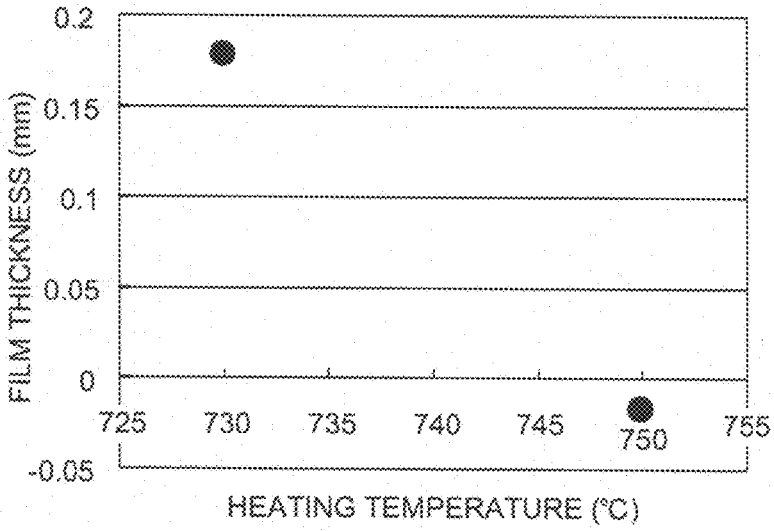
FIG. 16 depicts a relationship between an electrode heating temperature and a coat thickness if discharges are continuously generated.

Using each of these two electrodes, the discharges are continuously generated to form a thick coat. At this moment, the processing is performed on the electrode surface of 11 millimeters×5.5 millimeters. When the electrode is consumed by 1 millimeter, the processing is stopped. FIG. 16 depicts a relationship between an electrode heating temperature and a coat thickness if discharges are continuously generated. In FIG. 16, a horizontal axis indicates the heating temperature (in centigrade) of the electrode used for the discharge surface treatment, and a vertical axis indicates the thickness (in millimeters) of the coat if the discharge surface treatment is performed using the electrode that has been subjected to the heat treatment at the heating temperature indicated by the horizontal axis. On this vertical axis, a zero-millimeter point indicates the surface of the work, a negative region indicates the removal processing, and a positive region indicates the accumulation processing. If the discharge surface treatment is performed using the electrode manufactured at the heating temperature of 730° C., the coat at about 0.2 millimeter can be formed on the work. If the discharge surface treatment is performed using the electrode manufactured at the heating temperature of 750° C., the removal processing is performed. The electrode manufactured at the heating temperature of 730° C. corresponds to the result of forming the discharge trace in the elliptical arc shape by the single discharge. The electrode manufactured at the heating temperature of 750° C. corresponds to the result of forming the discharge trace in the crater shape dented at the center and raised at the surrounding by the single discharge.

Figure 17:
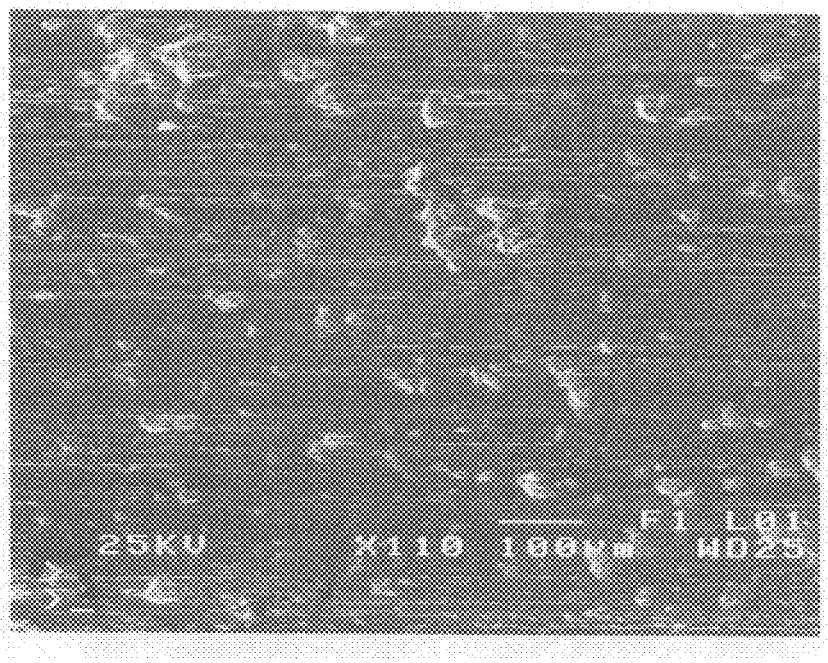
FIG. 17 is an SEM photograph of the coat formed by performing the discharge surface treatment using the electrode manufactured at the heating temperature of 730° C. after the coat is polished.

FIG. 17 is an SEM photograph of the coat formed by performing the discharge surface treatment using the electrode manufactured at the heating temperature of 730° C. after the coat is polished. As shown in the drawing, the entire surface of the electrode has a metallic luster and a highly compact coat can be formed.

According to the fourth embodiment, it is possible to grasp the manufacturing conditions for the electrode that can form the compact coat by the single discharge traces similarly to the second embodiment even if the current waveform differs from those according to the first to the third embodiments. According to the conventional technique, in order to actually form the coat by the discharge surface treatment, it takes some time for the processing. By contrast, the single discharge is finished momentarily, and it is possible to promptly evaluate whether the electrode is an optimum electrode having the conditions for forming the compact coat. Electrode manufacturing efficiency can be, therefore, improved.

According to a fifth embodiment of the present invention, an example in which the material or particle size of the powder differs from that of the powder according to the fourth embodiment will be explained.

According to the fifth embodiment, the electrode is manufactured using an alloy powder and a BN (boron nitride) powder serving as a solid lubricant according to the flowchart shown in FIG. 6. The composition of the alloy powder is the same as that explained in the third embodiment. The respective steps will be explained in detail. At the powder grinding step S1, the alloy powder at an average particle diameter of 6 micrometers is ground under the same grinding conditions as those according to the fourth embodiment until the powder has an average particle diameter of 1.2 micrometers. The alloy powder at an average particle diameter of 6 micrometers and the BN powder at an average particle diameter of 1 micrometer are mixed with the alloy powder thus ground at weight percentages of 9.5% and 0.5%, respectively.

The alloy powder is transformed to $Cr_2O_3$ that has the lubricity since Cr in the composition of the alloy powder is oxidized at a temperature near 800° C., so that the alloy powder exhibits an excellent wear resistance. However, at a temperature near 300° C. to 500° C., $Cr_2O_3$ does not appear and the alloy powder is, therefore, worn. For this reason, if the BN having the lubricity is mixed into the coat in advance, the coat that exhibits an excellent wear resistance at temperatures up to 1050° C. can be formed. Further, if the powder having a large average particle diameter is slightly present, the moldability of the powder during pressing at the later step is enhanced. For this reason, the alloy powder at the average particle diameter of 6 micrometers is mixed with the ground alloy powder. The alloy powder previously ground is present in acetone. Accordingly, the alloy powder at the average particle diameter of 6 micrometers and the BN powder are put into the acetone, and the powders are stirred by the ball mill, thereby mixing the four powders, i.e., the alloy powder at the average particle diameter of 1.2 micrometers, the alloy powder at the average particle diameter of 6 micrometers, and the BN powder at the average particle diameter of 1 micrometer.

Since details of the drying step S2, the mixing step S4 of mixing the wax with the powder, and the sieving step S5 are the same as those according to the fourth embodiment, they will not be explained herein. At the pressing step S6, 10 grams of powder that has been passed through the sieve mesh is put into the mold of 50 millimeters×11 millimeters, a pressure of 100 megapascals is applied to the surface of the electrode, and the powder is thereby pressed. As a result, a green compact of 50 millimeters×11 millimeters×5.5 millimeters is obtained.

At the heating step S7, the green compact thus obtained is put into the vacuum furnace and subjected to a heat treatment at a temperature of 700° C. for about 1 hour, and then subjected to self-cooling. When the green compact is cooled, the atmospheric air is introduced into the vacuum furnace and the vacuum furnace is then opened, whereby a conductive electrode is obtained.

Using the electrode thus manufactured, one discharge is generated with respect to the work consisting of a steel material SKD61. At this moment, the electrode side is set as the cathode and the work side is set as the anode, and the discharge surface treatment is performed. Discharge pulse conditions applied herein are the same as those according to the fourth embodiment. The single discharge trace has the elliptical arc shape similar to that shown in FIG. 9.

Thereafter, using this electrode, the discharges are continuously generated to form a thick coat. At this moment, the processing is performed on the electrode surface of 11 millimeters×5.5 millimeters. When the electrode is consumed by 1 millimeter, the processing is stopped. As a result, a coat at about 0.2 millimeter is formed. This coat is not peeled off even when rubbed by hand and is a compact coat without pores.

According to the fifth embodiment, even if the material or particle size of the powder differs, it is possible to grasp whether the electrode can accumulate a compact coat in the form of discharge traces formed by the single discharge.

As explained so far, the present invention has an advantage in that it is possible to easily determine whether the electrode can form a thick and compact coat by the discharge surface treatment before an actual processing is started.

According to the first to the fifth embodiments, the method for compression-molding the powder by pressing is explained as the method for molding the discharge surface-treating electrode. However, the method for manufacturing the discharge surface-treating electrode is not limited to the compression molding method by pressing or the like but other molding methods may be used as long as the method can ensure providing a molded powder. Examples of the method for molding the discharge surface-treating electrode other than the compression-molding method by pressing or the like include a method using slurry, a method based on MIM (Metal Injection Molding), a thermal spraying method, and a method for molding a nano powder to accompany a jet stream. The slurry method is for molding the powder by dispersing the powder into a solvent, putting a resultant liquid mixture into a porous mold such as a plaster mold, and thereby removing the solvent. The MIM method is for molding the powder by mixing a binder with the powder, and injecting the mixture into a heated mold. The thermal spraying method is for molding the powder in a state in which powders are partially bound with one another by spraying the powder in a heated state. Although these exemplary molding methods are different in the manner of molding, they all aim at molding the powder. If the powder binding state becomes a desired state, the method can be used as the method for molding the discharge surface-treating electrode.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A method of evaluating an electrode for discharge surface treatment for generating a discharge between the electrode and a workpiece in a treatment liquid or in the air using a green compact obtained by molding a metal, metal compound, or ceramic powder or other green compact obtained by heating the green compact as the electrode, and forming a coat consisting of an electrode material or a substance obtained by a reaction of the electrode material by a discharge energy on a surface of the workpiece, the method comprising:

evaluating a capability of the electrode to deposit the coat based on an amount of deposition of the electrode material on the surface of the workpiece after only a single discharge is generated between the electrode and the workpiece.

2. The method according to claim 1, wherein said evaluating comprises determining the capability of the electrode to deposit a coating thicker than 100 micrometers is based on the amount of deposition of the electrode material on the surface of the workpiece by the single discharge.

3. A method of evaluating an electrode for a discharge surface treatment, the method comprising:

manufacturing an electrode for evaluation by molding a metal, metal compound, or ceramic powder;

performing a single discharge on a workpiece using the electrode manufactured;

observing a trace of the single discharge formed on a surface of the workpiece; and determining a coating capability of the electrode for discharge surface treatment, which is manufactured under a same manufacturing condition as that for the electrode for evaluation, based on a result of the observing of only the single discharge.

4. The method according to claim 3, wherein the determining includes determining the coating capability of the electrode for discharge surface treatment based on a coating hardness of an electrode material deposited on the surface of the workpiece by the single discharge.

5. The method according to claim 3, wherein the determining includes determining the coating capability of the electrode for discharge surface treatment based on an amount of deposition of an electrode material on the surface of the workpiece by the single discharge.

6. The method according to claim 3, wherein the single discharge is performed only by a single-pulse discharge.

7. The method according to claim 3, wherein the determining comprises determining the coating capability of the electrode for discharge surface treatment based on characteristics of a deposition of the electrode material on the surface of the workpiece by the single discharge.

8. A method of evaluating an electrode for a discharge surface treatment, the method comprising:

manufacturing an electrode for evaluation by molding a metal, metal compound, or ceramic powder;

performing a single discharge on a workpiece using the electrode manufactured;

observing a trace of the single discharge formed on a surface of the workpiece; and determining a coating capability of the electrode for discharge surface treatment, which is manufactured under a same manufacturing condition as that for the electrode for evaluation, based on a result of the observing, wherein the determining includes determining the coating capability of the electrode for discharge surface treatment based on a shape of deposition of an electrode material on the surface of the workpiece by the single discharge.

9. The method according to claim 8, wherein it is determined that the electrode for discharge surface treatment possesses a good coating capability when a cross section of the shape of deposition is an elliptical arc.

10. A method of evaluating an electrode for discharge surface treatment for generating a discharge between the electrode and a workpiece in a treatment liquid or in the air using a green compact obtained by molding a metal, metal compound, or ceramic powder or other green compact obtained by heating the green compact as the electrode, and forming a coat consisting of an electrode material or a substance obtained by a reaction of the electrode material by a discharge energy on a surface of the workpiece, the method comprising:

evaluating a capability of the electrode to deposit the coat based on an amount of deposition of the electrode material on the surface of the workpiece when a single discharge is generated between the electrode and the workpiece, wherein the evaluating the capability of the electrode to deposit the coat is further based on a shape of the deposition of the electrode material on the surface of the workpiece by the single discharge.

11. A method of evaluating an electrode for discharge surface treatment for generating a discharge between the electrode and a workpiece in a treatment liquid or in the air using a green compact obtained by molding a metal, metal compound, or ceramic powder or other green compact obtained by heating the green compact as the electrode, and forming a coat consisting of an electrode material or a substance obtained by a reaction of the electrode material by a discharge energy on a surface of the workpiece, the method comprising:

evaluating a capability of the electrode to deposit the coat based on an amount of deposition of the electrode material on the surface of the workpiece when a single discharge is generated between the electrode and the workpiece, wherein the evaluating of the capability of the electrode is evaluating attributes of a deposition of the electrode material by a sole-discharge on an area of the surface of the workpiece.

* * * * *